United States Patent [19]

Marks

[11] Patent Number: 4,510,826

[45] Date of Patent: Apr. 16, 1985

[54] EXTENSION FOR A SCREWGUN

[75] Inventor: Milton Marks, Pittsburgh, Pa.

[73] Assignee: Guardian Fasteners and Closure Systems, Coraopolis, Pa.

[21] Appl. No.: 472,579

[22] Filed: Mar. 7, 1983

[51] Int. Cl.[3] ..... B25B 23/02

[52] U.S. Cl. ..... 81/57.37

[58] Field of Search ..... 81/57.37, 431; 227/147, 227/149

[56] References Cited

U.S. PATENT DOCUMENTS

| | | | |
|---|---|---|---|
| 3,526,257 | 9/1970 | Kirkland | 81/57.3 |
| 3,960,191 | 6/1976 | Murray | 81/57.37 |
| 4,204,439 | 5/1980 | Kondo | 81/57.37 |
| 4,236,555 | 12/1980 | Dewey | 81/431 |
| 4,294,142 | 10/1981 | Sugahara et al. | 81/57.37 |

FOREIGN PATENT DOCUMENTS

| | | | |
|---|---|---|---|
| 1503120 | 9/1969 | Fed. Rep. of Germany | 81/57.37 |

*Primary Examiner*—James L. Jones, Jr.

*Attorney, Agent, or Firm*—Robert D. Yeager; Andrew J. Cornelius; Christine R. Ethridge

[57] ABSTRACT

An attachment for a screwgun includes a hollow barrel and a hollow sleeve which is adapted for sliding movement with respect to the barrel. The sleeve and barrel are biased apart by a spring. A drive rod which extends through the hollow portions of the sleeve and barrel coacts with a screwgun to transfer the driving force of the screwgun to a fastener. A feed tube is attached to the barrel by a hinge which extends through a slot in the sleeve. An outlet end of the feed tube is in communication with a portal in the barrel through which a fastener may be inserted into the barrel when the feed tube is in a first position. In a second feed tube position, the outlet end of the feed tube and the portal of the barrel are spaced from each other.

11 Claims, 2 Drawing Figures

EXTENSION FOR A SCREWGUN

BACKGROUND OF THE INVENTION

1. Field of the Invention

The invention relates generally to an attachment for a screwgun which extends the reach of the screwgun.

2. Description of the Prior Art

Various attachments for screwguns have been developed which extend the reach of the screwgun to enable workmen using the tool to insert fasteners into floors and ceilings from a standing position.

Murray U.S. Pat. No. 3,960,191 discloses an extension attachment having upper and lower telescoping tubular sections which are biased away from each other with a spring. A drive rod extends through the interior of the tubular sections and a feed tube is fixed to the lower tubular section with a Y-shaped piece.

A similar screwgun attachment having a collapsible nosepiece is disclosed by Dewey U.S. Pat. No. 4,236,555. Use of the collapsible nosepiece in addition to two telescoping tubular sections shortens the overall length of the tool as compared to similar tools having rigid nosepieces. However, the necessity of using three moving parts and two springs, one of which is exposed, increases the probability of malfunction due to wear and damage.

Furthermore, the feed tubes of conventional screwgun extension attachments are fixed to one of the tubular sections. Damage to either member requires replacement of both.

Accordingly, it is the object of this invention to provide an extension attachment for screwguns having a short overall length but fewer parts and a releasably attached feed tube. It it a further object of this invention to provide means for controlling the depth to which a fastener is inserted into a work surface.

SUMMARY OF THE INVENTION

The present invention provides an attachment for a screwgun which includes a hollow barrel having a portal in its side for receiving a fastener, a hollow sleeve adapted for sliding movement with respect to the barrel, and a drive member disposed within the hollow portion of the barrel and the sleeve. The drive member is adapted to coact with the drive of a screwgun in order to transfer the driving force of the screwgun to a fastener. The barrel and the sleeve are biased apart, preferably by a spring. Apparatus hingedly connected to the barrel is provided for delivering a fastener through the portal into the barrel. The delivering apparatus, preferably a feed tube, is capable of assuming a first position in which its outlet end is in substantial alignment with the portal in the barrel and a second position in which its outlet end is spaced from the protal.

The screwgun attachment may further include apparatus for holding a fastener in place within the barrel as the fastener awaits coaction with the drive member. Expandable jaws may serve as such holding apparatus.

The sleeve slides over the barrel and may have an elongated slot along its length. The delivering apparatus is connected to the barrel by a hinge that extends through the elongated slot in the sleeve. The delivering apparatus may be erased from its first position to its second position by the sliding movement of the sleeve over the barrel past the area of communication between the portal in the barrel and the outlet end of the delivering apparatus.

The screwgun attachment may further include apparatus for adjusting the depth to which the fastener is inserted. Such adjusting apparatus may include a threaded nut disposed along an externally threaded portion of the barrel where such threaded portion is located intermediate the portal in the barrel and the open end of the barrel. The nut is adapted to limit the sliding movement of the sleeve with respect to the barrel.

DETAILED DESCRIPTION OF THE PREFERRED EMBODIMENTS

Figure 1:
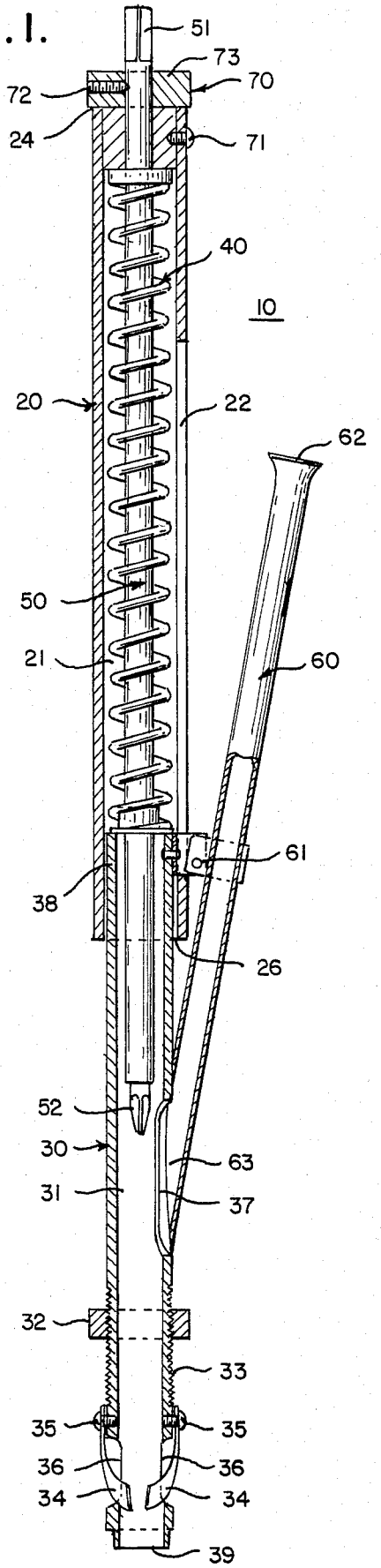
FIG. 1 is a sectional view of an attachment that can be constructed according to the teachings of the present invention.

Referring to the drawings, the attachment for a screwgun, generally indicated by the reference numeral 10, includes a hollow sleeve 20, a hollow barrel 30, a spring 40, a drive rod 50, a feed tube 60 and a bushing 70.

One end 24 of sleeve 20 is capped by bushing 70. The other end 26 of sleeve 20 is open. Upper end 38 of barrel 30 is positioned within the open end 26 of sleeve 20 for sliding movement with respect to sleeve 20. The remaining end 39 of barrel 30 is open. A nut 32 is threaded on threaded portion 33 of barrel 30. Nut 32 provides a stop for limiting the extent to which sleeve 20 can slide over barrel 30. A spring 40, which is disposed within sleeve 20 between bushing 70 and upper end 38 of barrel 30, urges sleeve 20 away from barrel 30 and, accordingly, urges attachment 10 toward its extended position shown in FIG. 1.

Drive rod 50 extends through an opening in bushing 70 and into the hollow portions of sleeve 20 and barrel 30. Drive rod 50 is adapted at its upper end 51 to coact with the drive of the screwgun. Bit 52, disposed at the lower end of drive rod 50, is adapted to engage a fastener. The drive of the screwgun causes drive rod 50 to rotate about its axis and, thus, to transfer the driving force of the screwgun to the fastener as the fastener is inserted into a work surface.

Expandable jaws 34, which are attached to the lower end of barrel 30 by screws 35, extend through slots 36 formed in the sides of barrel 30 intermediate threaded portion 33 and open end 39. Jaws 34 grip the head of a fastener and hold it in place within the hollow portion 31 of barrel 30 as the fastener awaits engagement with bit 52 and coaction with drive rod 50.

Figure 2:
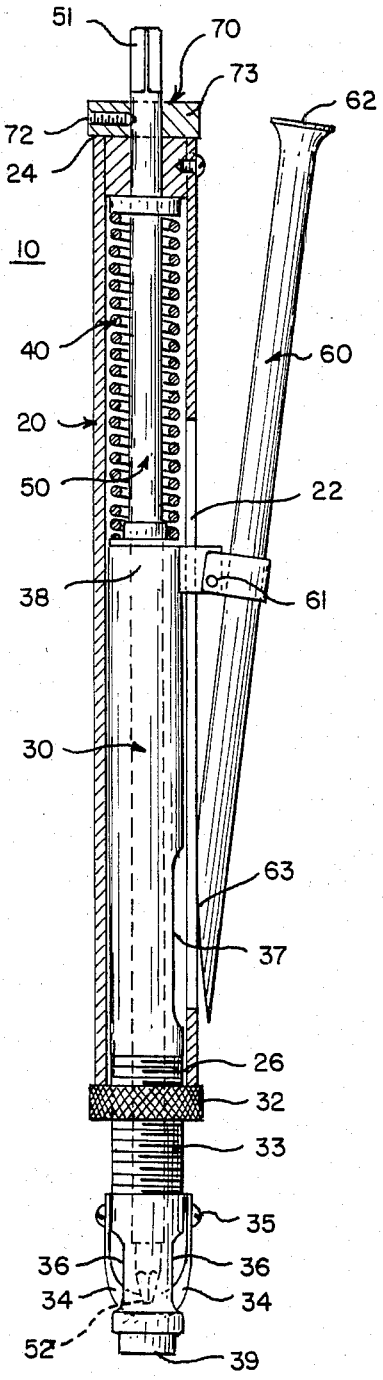
FIG. 2 is a sectional view of the attachment shown in FIG. 1 in a collapsed state.

Elongated slot 22 is formed along the length of sleeve 20. Portal 37 is formed in the side of barrel 30 above threaded portion 33 to receive fasteners. Feed tube 60, which delivers fasteners to barrel 30, is connected to barrel 30 by hinge 61 intermediate inlet end 62 and outlet end 63 of feed tube 60. Hinge 61 extends through elongated slot 22 in sleeve 20. Feed tube 60 can assume a first, extended position as illustrated in FIG. 1 in which outlet end 63 is in communication with portal 37 of barrel 30 and hinge 61 extends through the lower end of slot 22 of sleeve 20. As sleeve 20 slides over barrel 30, compressing spring 40, feed tube 60 moves toward its second, collapsed position in which outlet end 63 is spaced from portal 37 and hinge 61 moves toward the upper end of slot 22 as illustrated in FIG. 2.

Bushing 70 is attached to the upper end 24 of sleeve 20 by screw 71. Pin 72 extends through top portion 73 of bushing 70 to the periphery of the opening in bushing 70 through which drive rod 50 passes. Bushing 70 is interchangeable and may have one of a range of sizes to facilitate the use of attachment 10 with a variety of screwguns.

In actual use, attachment 10 is secured to the end of a screwgun by bushing 70 and upper end 51 of drive rod 50 is in engagement with the drive of the screwgun. A fastener is inserted into inlet end 62 of feed tube 60 so that it falls through feed tube 60, out of outlet 63, through portal 37, into barrel 30 and through barrel 30 to jaws 34, where it is held in place. Sleeve 20 slides over barrel 30, compressing spring 40 and bringing bit 52 of drive rod 50 into engagement with the fastener. Sleeve 20 continues to slide over barrel 30 until the end 26 of sleeve 20 hits nut 32. It can be seen that by adjusting the nut 32 on threaded portion 33 of barrel 30 the extension of drive rod 50 through barrel 30 is controlled and, thus, the depth to which the fastener can be inserted into a work surface is similarly controlled.

Activation of the driving force of the screwgun actuates rotation of drive rod 50 about its axis thereby transferring the driving force of the screwgun to the fastener.

What is claimed is:

1. An attachment for a screwgun comprising:

a hollow barrel having a portal in its side for receiving a fastener;

a hollow sleeve adapted for sliding movement relative to said barrel;

a drive member disposed within the hollow portions of said barrel and said sleeve and adapted to coact with the drive of the screwgun to transfer the driving force of the screwgun to the fastener;

means for biasing said barrel and said sleeve apart; and means hingedly connected to said barrel for delivering a fastener through said portal into said barrel;

said delivering means being capable of assuming a first position in which an outlet end of said delivering means is in communication with said portal and a second position in which said outlet end is spaced from said portal, said delivering means being eased from said first position to said second position by the sliding movement of said sleeve relative to said barrel past the area of communication between said portal and said outlet end of said delivering means.

2. An attachment for a screwgun as recited in claim 1 further comprising means for holding the fastener in place within said barrel as the fastener awaits coaction with said drive member.

3. An attachment for a screwgun as recited in claim 2 wherein said holding means are expandable jaws.

4. An attachment for a screwgun as recited in claim 1 wherein said biasing means is a spring.

5. An attachment for a screwgun as recited in claim 1 wherein said sleeve has an elongated slot along its length.

6. An attachment for a screwgun as recited in claim 5 wherein said delivering means is connected to said barrel by a hinge that extends through said elongated slot in said sleeve.

7. An attachment for a screwgun as recited in claim 1 wherein said delivering means is a feed tube.

8. An attachment for a screwgun as recited in claim 1 further comprising means for adjusting the depth to which the fastener is inserted.

9. An attachment for a screwgun as recited in claim 8 wherein said adjusting means comprises a threaded nut disposed along an externally threaded portion of said barrel, said threaded portion of said barrel being intermediate said portal and the open end of said barrel, and said nut being adapted to limit the sliding movement of said sleeve with respect to said barrel.

10. An attachment for a screwgun comprising:

a hollow barrel having a portal in its side for receiving a fastener;

a hollow sleeve adapted for sliding movement over said barrel, said sleeve having an elongated slot along its length;

a drive member disposed within the hollow portions of said barrel and said sleeve and adapted to coact with the drive of the screwgun to transfer the driving force of the screwgun to the fastener;

means for biasing said barrel and said sleeve apart;

means for delivering a fastener through said portal into said barrel;

a hinge extending through said elongated slot for hingedly connecting said delivering means to said barrel; and said delivering means being capable of assuming a first position in which an outlet end of said delivering means is in communication with said portal and a second position in which said outlet end is spaced from said portal.

11. An attachment for a screwgun as recited in claim 10 wherein said delivering means is eased from said first position to said second postion by the sliding movement of said sleeve over said barrel past the area of communication between said portal and said outlet end of said delivering means.

* * * * *